US010813411B2

(12) United States Patent
Jeon

(10) Patent No.: US 10,813,411 B2
(45) Date of Patent: Oct. 27, 2020

(54) LACE ADJUSTMENT DEVICE

(71) Applicant: Hyo Seok Jeon, Seoul (KR)

(72) Inventor: Hyo Seok Jeon, Seoul (KR)

( * ) Notice: Subject to any disclaimer, the term of this patent is extended or adjusted under 35 U.S.C. 154(b) by 0 days.

(21) Appl. No.: 16/478,318

(22) PCT Filed: Jan. 25, 2018

(86) PCT No.: PCT/KR2018/001124
§ 371 (c)(1),
(2) Date: Jul. 16, 2019

(87) PCT Pub. No.: WO2018/139873
PCT Pub. Date: Aug. 2, 2018

(65) Prior Publication Data

US 2019/0380446 A1 Dec. 19, 2019

(30) Foreign Application Priority Data

Jan. 26, 2017 (KR) ..... 10-2017-0012538

(51) Int. Cl.
*A43C 11/14* (2006.01)

(52) U.S. Cl.
CPC ..... *A43C 11/14* (2013.01)

(58) Field of Classification Search
CPC ..... A43C 11/14; A43C 11/00; A43C 11/22; A43C 7/00; A43C 7/02; A43C 1/00; A43C 7/08
See application file for complete search history.

(56) References Cited

U.S. PATENT DOCUMENTS 1,481,903 A * 1/1924 Hart ..... A43C 7/00 24/712.6
2,315,196 A * 3/1943 Gallione ..... B65D 19/44 248/499
5,097,573 A * 3/1992 Gimeno ..... A43C 7/00 24/712.2
6,467,194 B1 * 10/2002 Johnson ..... A43C 1/06 36/118.1

(Continued)

FOREIGN PATENT DOCUMENTS

KR 20-0227601 Y1 6/2001
KR 20-0314693 Y1 5/2003

(Continued)

*Primary Examiner* — Robert Sandy
*Assistant Examiner* — Louis A Mercado
(74) *Attorney, Agent, or Firm* — Novick, Kim & Lee, PLLC; Jae Youn Kim

(57) ABSTRACT

Provided is a lace adjustment device for adjusting a lace provided at a shoe or clothes, the device including: a housing having a lace insertion hole into which the lace is inserted; a fixing lever, disposed in the housing, for fixing the lace inserted into the housing; and an elastic member disposed in the housing and providing an elastic force to the fixing lever such that the fixing lever presses the lace inserted into the housing. According to the lace adjustment device according to the exemplary embodiments of the present invention, a user may conveniently adjust a length of a lace provided at a shoe, clothes, or the like by simply pressing a button instead of directly pulling and tying, from both sides, the lace attached to the shoe, the clothes, or the like.

6 Claims, 9 Drawing Sheets

(56) References Cited

U.S. PATENT DOCUMENTS

| | | | | |
|---|---|---|---|---|
| 6,896,128 | B1 * | 5/2005 | Johnson | A43C 1/06 36/118.1 |
| 7,661,205 | B2 * | 2/2010 | Johnson | A43C 7/04 36/50.1 |
| 7,946,007 | B2 * | 5/2011 | Borsoi | A43C 7/08 114/218 |
| 8,141,273 | B2 * | 3/2012 | Stramare | A43C 7/08 24/134 P |
| 8,332,994 | B2 * | 12/2012 | Lin | A43C 1/00 24/712.5 |
| 8,371,004 | B2 * | 2/2013 | Huber | A43B 5/0401 24/132 R |
| 2006/0168784 | A1 * | 8/2006 | Ahn | A43C 7/08 24/712.5 |
| 2010/0192411 | A1 * | 8/2010 | Leick | A43C 7/00 36/50.1 |

FOREIGN PATENT DOCUMENTS

| | | | |
|---|---|---|---|
| KR | 20-0317479 | Y1 | 6/2003 |
| KR | 20-0323590 | Y1 | 8/2003 |
| KR | 20-2011-0009740 | U | 10/2011 |
| KR | 10-1471179 | B1 | 12/2014 |
| KR | 10-2017-0001249 | A | 1/2017 |

* cited by examiner

LACE ADJUSTMENT DEVICE

TECHNICAL FIELD

The present invention relates to a lace adjustment device, and more particularly, to a lace adjustment device for adjusting a lace provided at a shoe or clothes.

BACKGROUND ART

In general, products such as clothes and shoes are provided with separate laces so that the laces may be adjusted in size in accordance with a wearer's size or preference.

A user, who uses a product, directly ties a lace attached to the product such as a shoe or clothes. In this case, the user may securely tie and fasten the lace in accordance with his/her preference and may increase or decrease a length of the lace. In other words, the user pulls and tightens the lace attached to the shoe, the clothes, or the like and makes a knot, thereby fastening the lace to the shoe, the clothes, or the like.

Meanwhile, because an old and weak person such as a child is not familiar with tying the lace attached to the shoe, the clothes, or the like, a protector ties the lace attached to the child's shoe, clothes, or the like or fastens the lace by using a separate method of tying the lace so that the lace is not untied, and then the protector adjusts a length of the lace.

However, there is a problem in that the lace cannot be securely fastened to the shoe, the clothes, or the like, but the lace is easily untied even though the lace attached to the shoe, the clothes, or the like is tied several times by using the separate method.

Furthermore, when the lace attached to the child's shoe, clothes, or the like cannot be securely fastened but untied, there is a risk that an accident occurs when the child falls over by stepping on the untied lace or by being caught by the untied lace.

In addition, the separate method of tying the lace is difficult for an old and weak person such as a child to use, and it is very troublesome to put on or take off the shoe, the clothes, or the like when necessary if the lace is tied incorrectly.

Therefore, the present applicant has proposed the present invention to solve the above-mentioned problems, and as a document of related art, there is Korean Utility Model Registration No. 20-0323590 (Title of Invention: Shoelace Fastening Device registered on Aug. 5, 2003).

DISCLOSURE

Technical Problem

An object of the present invention is to provide a lace adjustment device capable of easily adjusting a length of a lace attached to a shoe, clothes, or the like and stably holding the lace so that the lace is not untied from the clothes, the shoe, or the like.

Technical problems to be solved by the present invention are not limited to the above-mentioned technical problems, and other technical problems, which are not mentioned above, may be clearly understood by those skilled in the art from the following descriptions.

Technical Solution

The above-mentioned object is achieved by a lace adjustment device, which is configured to adjust a lace provided at a shoe or clothes, the lace adjustment device including: a housing which has lace insertion holes into which the lace is inserted; fixing levers which are disposed in the housing and configured to fix the lace inserted into the housing; and an elastic member which is disposed in the housing and provides elastic force to the fixing levers so that the fixing levers press the lace inserted into the housing.

The fixing levers may be provided to be rotatable about pivot shafts provided in the housing.

The lace adjustment device may further include a push member which is provided at a position adjacent to the fixing levers and rotates the fixing levers by a user's push operation to release a pressure of the fixing levers applied to the lace.

The fixing levers may be provided in a pair at left and right sides based on the push member, the lace insertion holes may be formed in a pair, at the left and right sides, in the housing, and the housing may have a pair of lace outlet holes through which the lace, which is inserted into the housing through the lace insertion holes, is withdrawn to the outside of the housing, a pair of second lace insertion holes through which the lace, which is withdrawn to the outside of the housing through the lace outlet holes, is inserted into the housing, and a pair of second lace outlet holes through which the lace, which is inserted into the housing through the second lace insertion holes, is withdrawn to the outside of the housing.

The lace adjustment device may further include a lace support unit which is provided in the housing, allows the lace inserted into the housing to be seated thereon, and supports the lace pressed by the fixing levers.

The elastic member may be interposed between an inner wall of the housing and the fixing levers.

The fixing levers may be provided in a pair at left and right sides based on the push member, and the elastic member may be disposed between the pair of fixing levers provided at the left and right sides and may connect the pair of fixing levers at the left and right sides.

The fixing levers may be provided in a pair in an up-down direction at left and right sides based on the push member, the push members may be provided in a pair in the up-down direction, and the lace may be positioned between the fixing levers provided in a pair in the up-down direction.

The elastic member may be disposed at a position adjacent to the push member, and the push member may be configured to transmit the elastic force of the elastic member to the fixing levers.

The push member may be coupled to and may engage with the fixing levers, and the elastic member may be interposed between an inner wall of the housing and the push member and may provide the elastic force to the fixing levers through the push member.

Teeth, which engage with one another, are formed on an outer surface of the push member and outer surfaces of the fixing levers.

The push member may be disposed in a central region at an upper side of the housing, the fixing levers may be provided in a pair at left and right sides based on the push member, and the elastic member may be disposed at a lower end of the push member and may apply the elastic force in a direction in which the push member is pushed.

Advantageous Effects

According to the lace adjustment device according to the present invention, a user may conveniently adjust the length of the lace provided at the shoe, the clothes, or the like by simply pressing the button instead of directly pulling and tying, from both sides, the lace attached to the shoe, the clothes, or the like.

In addition, the lace adjustment device according to the present invention may stably hold the lace attached to the shoe or the clothes to prevent the lace from being untied from the shoe or the clothes.

BEST MODE

Figure 1A:
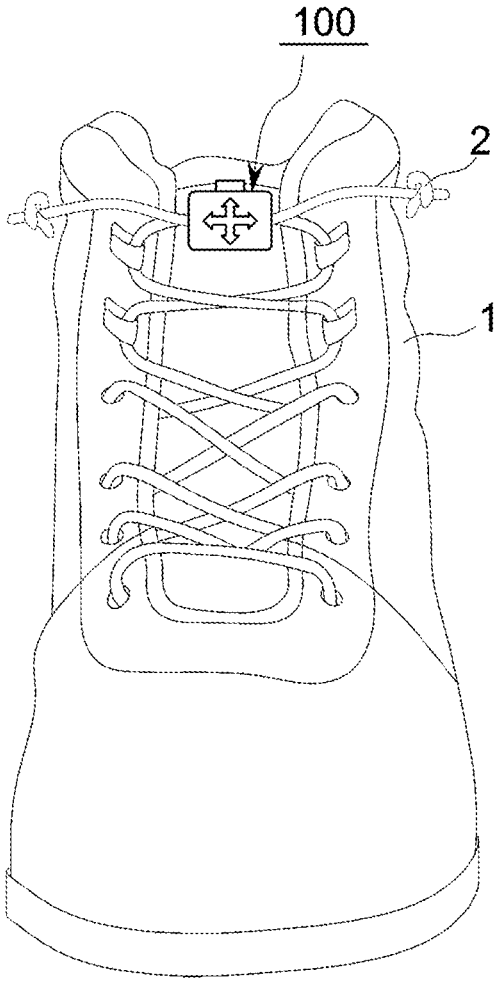
FIG. 1 is a use state view of a lace adjustment device according to exemplary embodiments of the present invention.

Hereinafter, exemplary embodiments of the present invention will be described in detail with reference to the accompanying drawings so that those skilled in the technical field to which the present invention pertains may easily carry out the exemplary embodiment. The present disclosure may be implemented in various different ways and is not limited to the exemplary embodiments described herein.

It is noted that the drawings are schematic and are not illustrated based on actual scales. Relative dimensions and proportions of parts illustrated in the drawings are exaggerated or reduced in size for the purpose of clarity and convenience in the drawings, and any dimension is just illustrative but not restrictive. The same reference numerals designate the same structures, elements or components illustrated in two or more drawings in order to exhibit similar characteristics.

Exemplary embodiments of the present disclosure illustrate ideal exemplary embodiments of the present disclosure in detail. As a result, various modifications of the drawings are expected. Therefore, the exemplary embodiments are not limited to specific forms in regions illustrated in the drawings, and for example, include modifications of forms by the manufacture thereof.

Hereinafter, lace adjustment devices 100 and 200 according to exemplary embodiments according to the present invention will be described with reference to the accompanying drawings.

First, each of the lace adjustment devices 100 and 200 according to the exemplary embodiments of the present invention is mounted on a lace provided at a shoe, clothes, or the like and adjusts a length of the lace. For example, as illustrated in FIG. 1, each of the lace adjustment devices 100 and 200 stably holds a lace 2 provided at a shoe 1 to prevent the lace 2 from being untied from the shoe, the clothes, or the like and to adjust a length of the lace 2.

For reference, for convenience of description, each of the lace adjustment devices 100 and 200 will be described below as being mounted on the lace 2 provided at the shoe 1, but each of the lace adjustment devices 100 and 200 may be mounted not only on the shoe 1, but also on a product such as clothes, an accessory, or the like having a lace.

First, the lace adjustment device 100 according to the first exemplary embodiment of the present invention will be described with reference to FIGS. 2 to 4.

Figure 2:
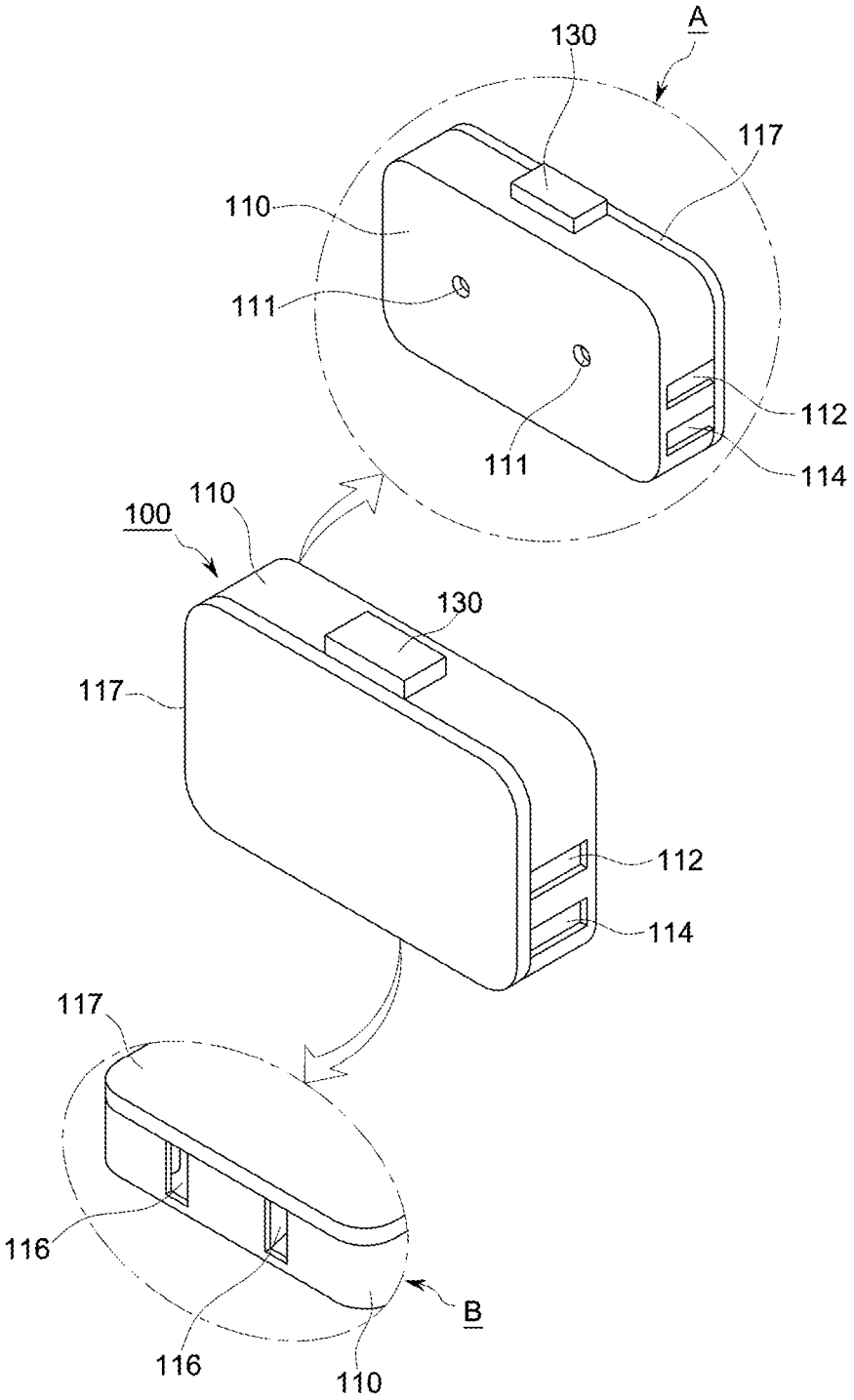
FIG. 2 is a perspective view of a lace adjustment device according to a first exemplary embodiment of the present invention.
Figure 3:
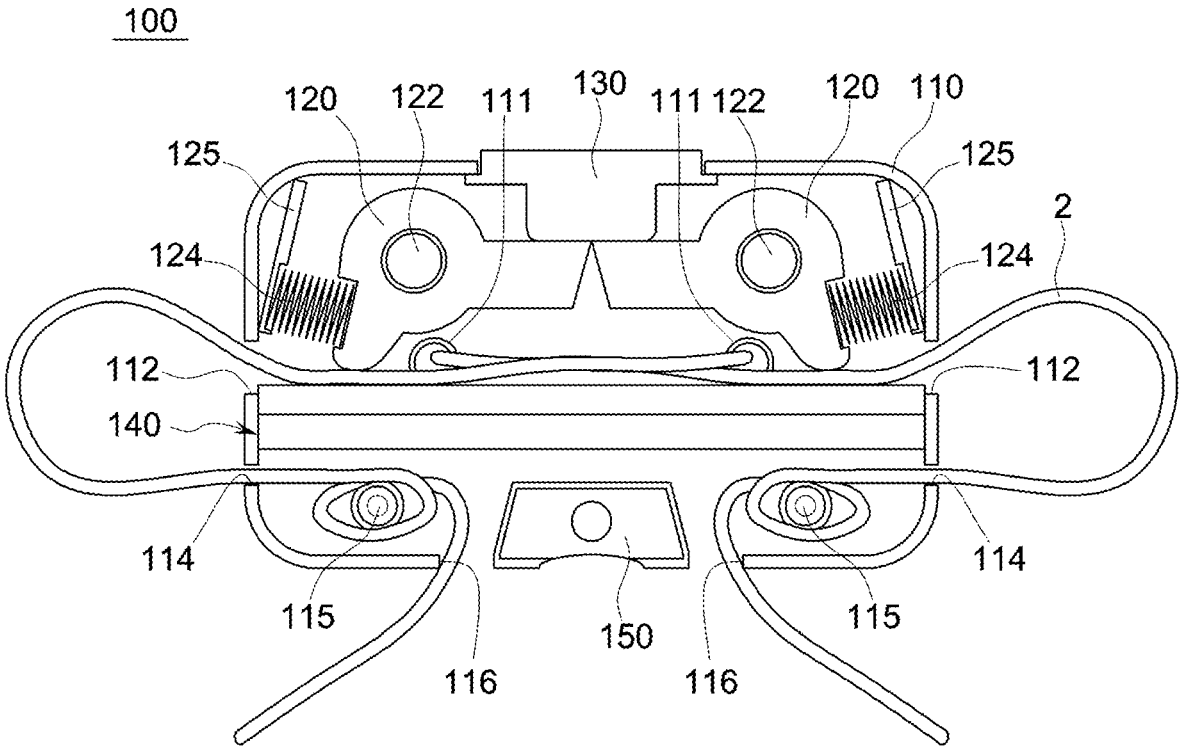
FIG. 3 is a view for explaining an internal configuration of the lace adjustment device illustrated in FIG. 2.
Figure 4:
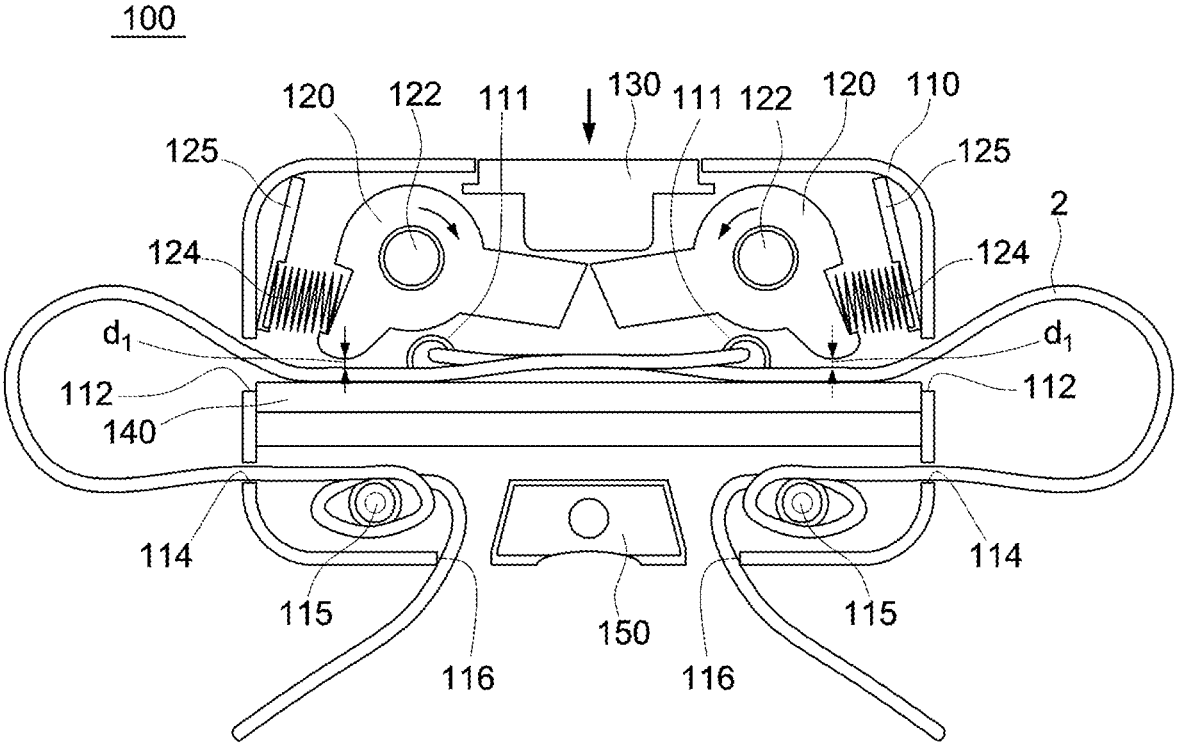
FIG. 4 is a view for explaining an operation of the lace adjustment device illustrated in FIG. 3.

As illustrated in FIGS. 2 to 4, the lace adjustment device 100 according to the first exemplary embodiment of the present invention includes a housing 110 which has lace insertion holes 111 into which the lace 2 provided at the shoe or the clothes is inserted, fixing levers 120 which are disposed in the housing 110 and fix the lace 2 inserted into the housing 110, and elastic members 124 which are disposed in the housing 110 and provide elastic force to the fixing levers 120 so that the fixing levers 120 press the lace 2 inserted into the housing 110.

Referring to FIGS. 2 to 4, the housing 110 serves as a casing of the lace adjustment device 100 according to the first exemplary embodiment of the present invention, and the fixing levers 120, the elastic members 124, and a push member 130, which will be described below, are mounted in the housing 110.

In this case, the lace 2 provided at the shoe or the clothes is inserted into the housing 110. In other words, the lace 2 is inserted into the housing 110 through the lace insertion holes 111 formed in the housing 110. The lace insertion holes 111 are formed in the housing 110, and the lace 2 is inserted into the lace insertion holes 111.

Meanwhile, as illustrated in FIGS. 2 to 4, the lace 2, which is inserted into the housing 110 through the lace insertion holes 111 formed in the housing 110, is withdrawn to the outside of the housing 110 through the lace outlet holes 112 formed in the housing 110.

Here, the pair of lace insertion holes 111 is provided, at the left and right sides, in a rear surface of the housing 110, and the pair of lace outlet holes 112 is provided, at the left and right sides, in lateral surfaces of the housing 110. In this case, the lace 2, which is inserted through the lace insertion hole 111 provided at the left side, between the pair of lace insertion holes 111 formed in the rear surface of the housing 110, is withdrawn to the outside of the housing 110 through the lace outlet hole 112 formed in the right surface of the housing 110, and the lace 2, which is inserted through the lace insertion hole 111 provided at the right side, between the pair of lace insertion holes 111 formed in the rear surface of the housing 110, is withdrawn to the outside of the housing 110 through the lace outlet hole 112 formed in the left surface of the housing 110. Therefore, as illustrated in FIG. 1A, the lace 2 passing through the lace adjustment device 100 is provided in a straight shape. In other words, the lace 2, which is inserted through the pair of lace insertion holes 111, is crossed and withdrawn to the outside of the housing 110 through the pair of lace outlet holes 112 provided at the left and right sides.

Meanwhile, as illustrated in FIGS. 3 and 4, the lace adjustment device 100 according to the first exemplary embodiment of the present invention further includes second lace insertion holes 114 and second lace outlet holes 116. The lace 2, which is withdrawn to the outside of the housing 110 through the lace outlet holes 112, is inserted into the housing 110 through the second lace insertion holes 114. The lace 2, which is inserted into the housing 110 through the second lace insertion holes 114, is withdrawn to the outside of the housing 110 through the second lace outlet holes 116.

Figure 1B:
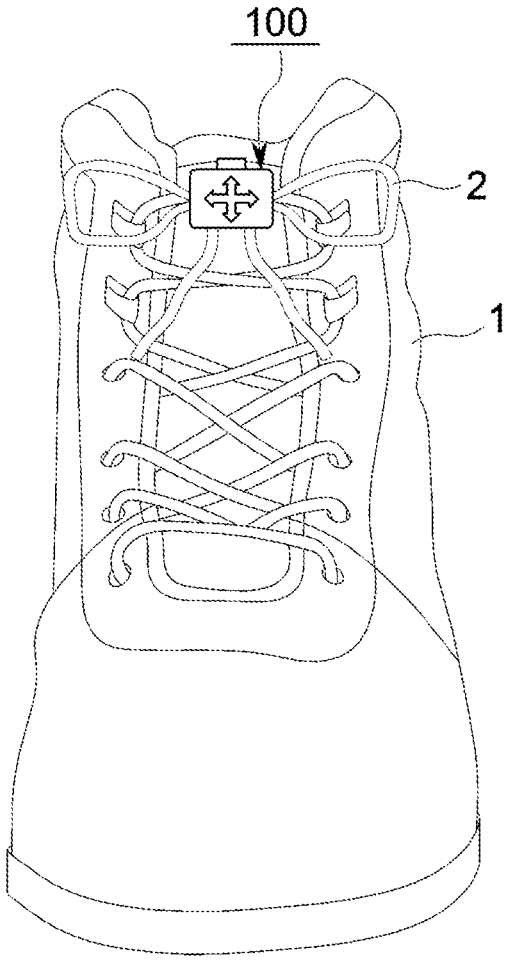

The pair of second lace insertion holes 114 is provided, at the left and right sides, in the lateral surfaces of the housing 110, and the pair of second lace outlet holes 116 is provided, at the left and right sides, in a lower surface of the housing 110. In this case, the lace 2, which is withdrawn through the pair of lace outlet holes 112 formed in the housing 110, is inserted into the housing 110 through the second lace insertion holes 114, and the lace 2, which is inserted into the housing 110 through the pair of second lace insertion holes 114, is withdrawn to the outside of the housing 110 through the pair of second lace outlet holes 116. Therefore, as illustrated in FIG. 1B, the lace 2 of the shoe 1 is inserted into the housing 110 and withdrawn to the outside of the housing 110 while sequentially passing through the lace insertion holes 111, the lace outlet holes 112, the second lace insertion holes 114, and the second lace outlet holes 116, such that the lace 2 has a ribbon shape.

Referring to FIGS. 3 and 4, the fixing levers 120 are members that press and fix the lace 2. The fixing levers 120 are disposed in the housing 110 and press and fix the lace 2 which is inserted into the housing 110 through the lace insertion holes 111 formed in the housing 110. The fixing levers 120 are provided to be rotatable about pivot shafts 122 provided in the housing 110. In other words, the fixing levers 120 are rotated upward or downward about the pivot shafts 122. For reference, the upward or downward rotation range of the fixing levers 120 may vary depending on a size of the housing 110 and sizes of the fixing levers 120.

Meanwhile, as illustrated in FIGS. 3 and 4, the lace adjustment device 100 according to the exemplary embodiment of the present invention further includes a lace support unit 140. The lace support unit 140 is provided in the housing 110, the lace 2 inserted into the housing 110 is seated on the lace support unit 140, and the lace support unit 140 supports the lace 2 pressed by the fixing levers 120.

The lace support unit 140 is made of various materials such as metal or plastic. In addition, one surface of the lace support unit 140 is made of a material such as rubber or silicone and thus creates friction with the lace 2 seated on the lace support unit 140, such that the lace 2 is easily seated on the lace support unit 140 without slipping. For reference, the lace support unit 140, which is made of a material such as rubber or silicone, may also absorb impact applied by the fixing levers 120 when the fixing levers 120 press the lace 2.

Meanwhile, the fixing levers 120 receives elastic force from the elastic members 124 and are rotated by the elastic force.

Referring to FIGS. 3 and 4, the elastic members 124 provide the elastic force to the fixing levers 120. That is, each of the elastic members 124 is a kind of mechanical element that provides the elastic force to each of the fixing levers 120. Each of the elastic members 124 is configured as, for example, a spring and provides restoring force or elastic force of the spring to each of the fixing levers 120.

Meanwhile, the elastic members 124 are interposed between the fixing levers 120 and an inner wall of the housing 110. Specifically, one end of the elastic member 124 is in contact with the inner wall of the housing 110, and the other end of the elastic member 124 is in contact with the fixing lever 120. For reference, one end of the elastic member 124, which is in contact with the inner wall of the housing 110, is in contact with the inner wall of the housing 110 through a separate support plate 125.

Here, the support plate 125 is provided to be inclined on the inner wall of the housing 110. Therefore, the elastic members 124, which are in contact with the support plates 125, are positioned to be inclined with respect to the inner wall of the housing 110, and the fixing levers 120 are also positioned to be inclined with respect to the inner wall of the housing 110.

Meanwhile, the lace adjustment device 100 according to the first exemplary embodiment of the present invention further includes the push member 130 which releases the pressure of the fixing levers 120 applied to the lace 2.

Referring to FIGS. 2 to 4, the push member 130 is provided at an upper side of the housing 110 so as to be positioned adjacent to the fixing levers 120, and the push member 130 is disposed to be partially exposed. The push member 130 is configured in the form of a button to allow a user to easily perform a push operation, and the push member 130 may be made of various materials such as plastic.

Here, when the push member 130 is pushed by the user's push operation, the fixing levers 120 are also pushed. The fixing levers 120 are rotated in one direction while being pushed, such that the pressure of the fixing levers 120 applied to the lace 2 is released. In this case, the push member 130 is pushed in a direction opposite to the direction of the elastic force provided by the fixing levers 120, such that the fixing levers 120 are rotated in the direction opposite to the direction of the provided elastic force.

Meanwhile, the pair of fixing levers 120 is provided at the left and right sides based on the push member 130. In this case, the pair of fixing levers 120 provided at the left and right sides has the same form and the same shape. In addition, the pair of fixing levers 120 receives the elastic force from the elastic members 124 provided on the pair of fixing levers 120, respectively.

Here, as illustrated in FIG. 2, a housing cover 117 is coupled to one surface of the housing 110 after the components such as the fixing levers 120, the elastic members 124, and the push member 130 are positioned in the housing 110.

The housing cover 117 is a cover that covers the housing 110 and protects the components positioned in the housing 110. In this case, the housing cover 117 is coupled to a front surface of the housing 110 by being fitted with fixing grooves 115 provided in the housing 110, and the housing 110 and the housing cover 117 are securely coupled by a cover fixing unit 150.

For reference, the housing cover 117 may be coupled to the housing 110 after the lace 2 is inserted into the housing 110, or the housing cover 117 may be coupled to the housing 110 in a state in which the lace 2 is not inserted.

Hereinafter, an operation of the lace adjustment device 100 according to the present invention will be briefly described with reference to FIGS. 2 to 4.

First, the lace 2 of the shoe, the clothes, or the like is inserted into the housing 110 through the lace insertion holes 111 formed in the housing 110, and then the lace 2 is withdrawn through the lace outlet holes 112.

The push member 130 is pushed to adjust a length of the lace 2 from the shoe or the clothes. In this case, when the push member 130 is pushed, the fixing levers 120, which are provided adjacent to the push member 130, are also pushed.

The fixing levers 120 are rotated in one direction while being pushed by the push member 130. In this case, the fixing levers 120 are rotated in the direction opposite to the direction of the elastic force provided by the elastic members 124.

When the fixing levers 120 are rotated in the direction opposite to the direction of the elastic force provided by the elastic members 124, the contact between the fixing levers 120 and the lace 2 is released, and the pressure of the fixing levers 120 applied to the lace 2 is released. In this case, when the pressure of the fixing levers 120 applied to the lace 2 is released, intervals d1 are formed between the lace 2 and the fixing levers 120.

The user adjusts the length of the lace 2 in accordance with the user's preference by loosening or pulling the lace 2 exposed to the outside of the housing 110 by using the intervals d1 formed between the lace 2 and the fixing levers 120. For reference, when the lace 2 withdrawn to the outside of the housing 110 is too long or when the user intends to prettily tie the lace 2 with respect to the shoe or the clothes, the user inserts the lace 2, which is withdrawn through the lace outlet holes 112, into the second lace insertion holes 114, and then withdraws the lace 2, which is inserted into the second lace insertion holes 114, through the second lace outlet holes 116, such that the lace 2 has a ribbon shape.

Meanwhile, modified examples of the lace adjustment device 100 according to the first exemplary embodiment of the present invention will be described with reference to FIGS. 5 to 7.

Figure 5:
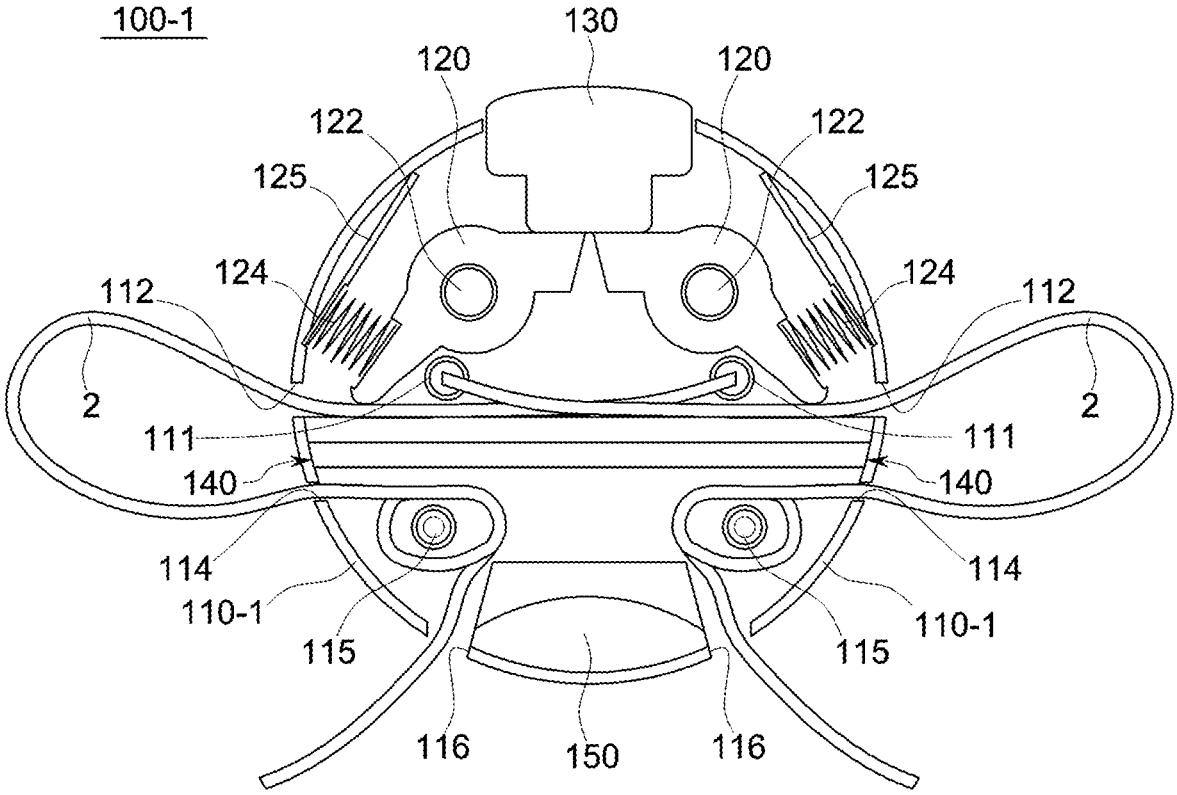
FIGS. 5 to 7 are views illustrating modified examples of the lace adjustment device according to the first exemplary embodiment of the present invention.
Figure 6:
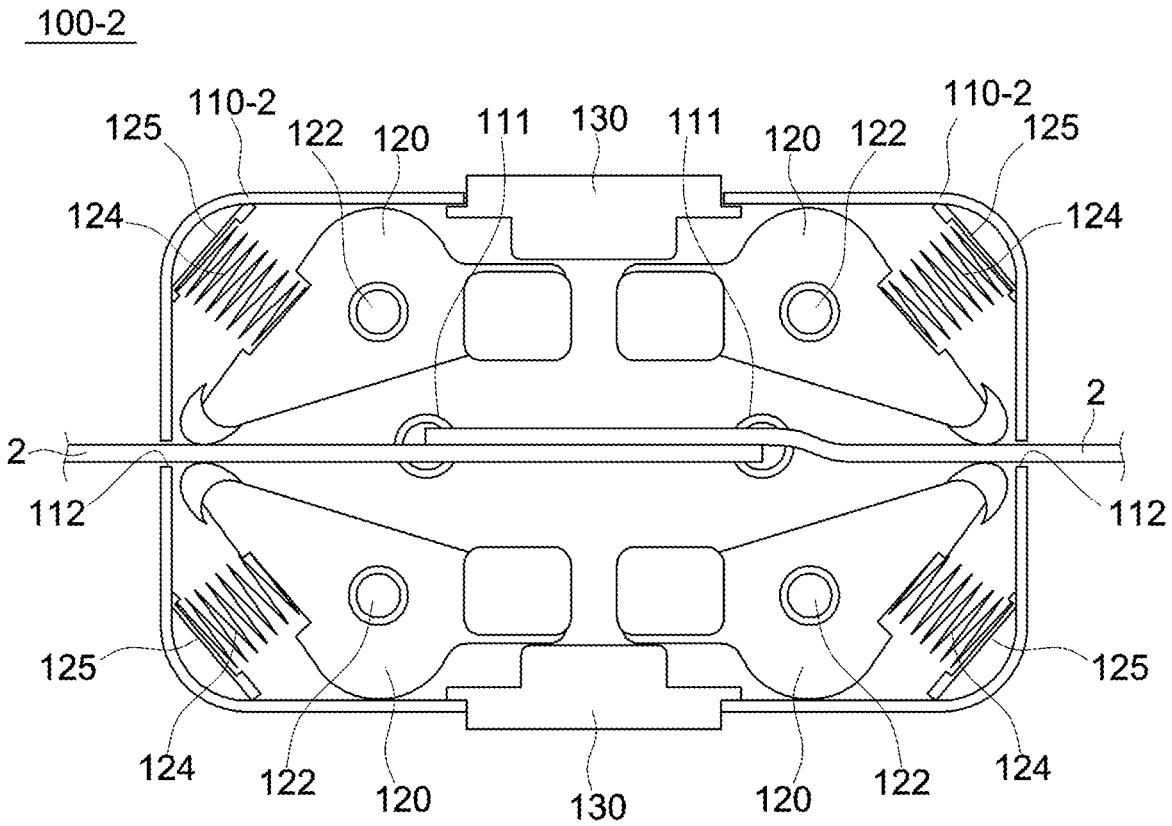
Figure 7:
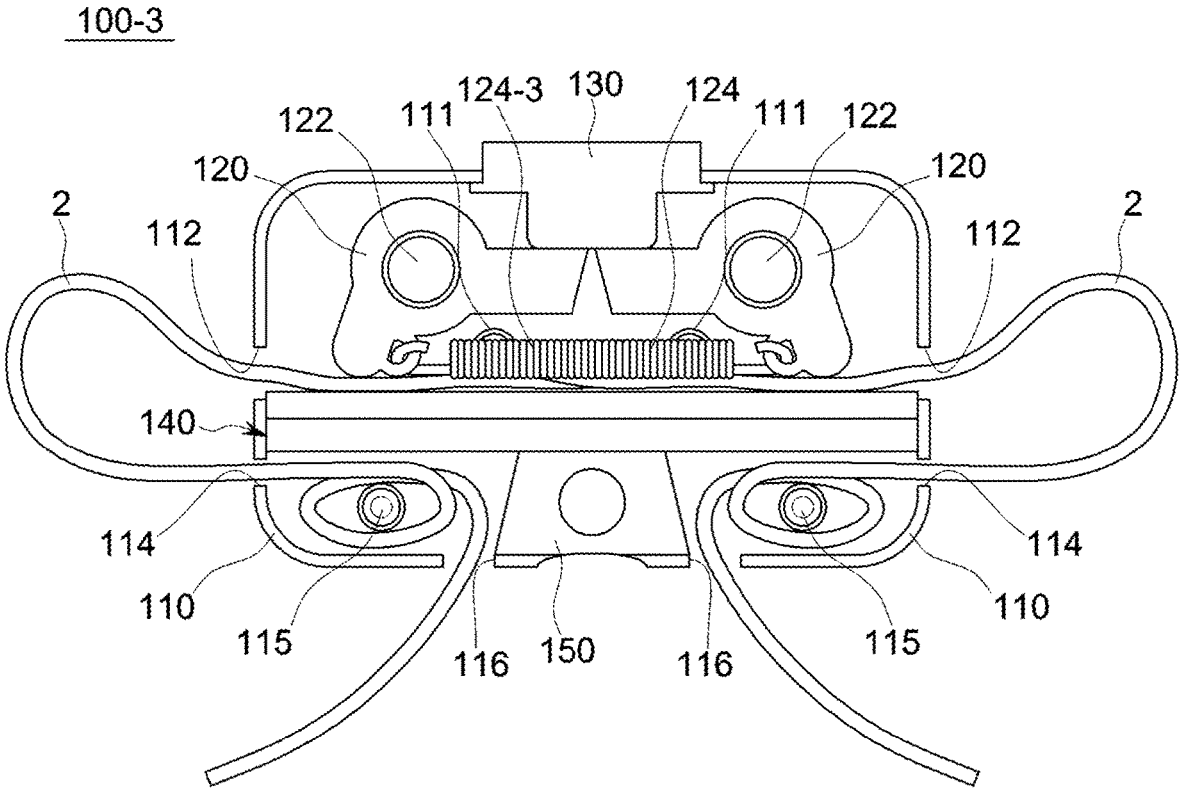

Because lace adjustment devices 100-1, 100-2, and 100-3 illustrated in FIGS. 5 to 7 are identical to the lace adjustment device according to the first exemplary embodiment except for some configurations of the modified examples of the lace adjustment device 100 according to the first exemplary embodiment, the same configuration is denoted by the same name and the same reference numeral, and the description of the first exemplary embodiment will be applied to the description of the configuration.

Referring to FIG. 5, a housing 110-1 has a circular shape. In other words, the housing 110 has a quadrangular shape, but as illustrated in FIG. 5, the housing 110-1 has a circular shape. In the case in which the housing 110-1 has the circular shape, the fixing levers 120 and the push member 130 may be deformed in shape, but the fixing levers 120, the elastic members 124, and the push member 130 have the same functions as those in the above-mentioned exemplary embodiment.

Referring to FIG. 6, the push members 130 are provided at an upper side and a lower side of a housing 110-2, respectively, and the fixing levers 120 are also provided at the upper side and the lower side of the housing 110-2, respectively. In this case, the pair of fixing levers 120 is provided, at the left and right sides, based on the push members 130 which are provided at the upper side and the lower side of the housing 110-2, respectively. Therefore, a total of four fixing levers 120 are provided in the housing 110-2.

Here, when the lace 2 is inserted into the housing 110 through the lace insertion holes 111 formed in the housing 110-2, the lace 2 is positioned between the pair of fixing levers 120 provided at the upper side and the lower side. In other words, as illustrated in FIG. 6, the lace 2 is fixed in the housing 110 by being pressed by the fixing levers 120 provided at the upper side and the fixing levers 120 provided at the lower side. In this case, the lace support unit 140 is not provided in the housing 110-2, and the pair of fixing levers 120 provided at the upper side and the pair of fixing levers 120 provided at the lower side serve as the lace support unit 140.

For reference, a separate friction member (not illustrated) is provided at one end of each of the fixing levers 120, which is in contact with the lace 2, to increase contact force between the lace 2 and the fixing levers 120.

Meanwhile, the lace 2, which is inserted into the housing 110-2 through the lace insertion holes 111 formed in the housing 110-2, is withdrawn to the outside of the housing 110-2 through the lace outlet holes 112 formed in the housing 110-2. In this case, because the second lace insertion holes 114 and the second lace outlet holes 116 are not formed in the housing 110-2, the lace 2, which is withdrawn to the outside of the housing 110-2 through the lace outlet holes 112, is not inserted into the housing 110-2 again.

Referring to FIG. 7, an elastic member 124-3 is provided between the pair of fixing levers 120 provided at the left and right sides based on the push member 130.

The elastic member 124-3 is disposed between the pair of fixing levers 120 provided at the left and right sides. In this case, one end of the elastic member 124-3 is connected to the fixing lever 120 positioned at the left side, and the other end of the elastic member 124-3 is connected to the fixing lever 120 positioned at the right side, such that the elastic member 124-3 connects the pair of fixing levers 120 provided at the left and right sides.

As described above, the elastic member 124-3 connects the pair of fixing levers 120 provided at the left and right sides and pulls the pair of fixing levers 120 to restrict the rotations of the fixing levers 120. Therefore, the fixing levers 120 are not rotated in the direction opposite to the direction of the elastic force of the elastic member 124 before the fixing levers 120 are pushed by the push member 130.

Here, the elastic member 124-3 may be configured in the form of a general spring, but the elastic member 124-3 may be configured in the form of a spring having loops provided at both ends thereof to connect the pair of fixing levers 120 provided at the left and right sides.

Meanwhile, the lace adjustment device 200 according to the second exemplary embodiment of the present invention will be described with reference to FIGS. 8 and 9.

Figure 8:
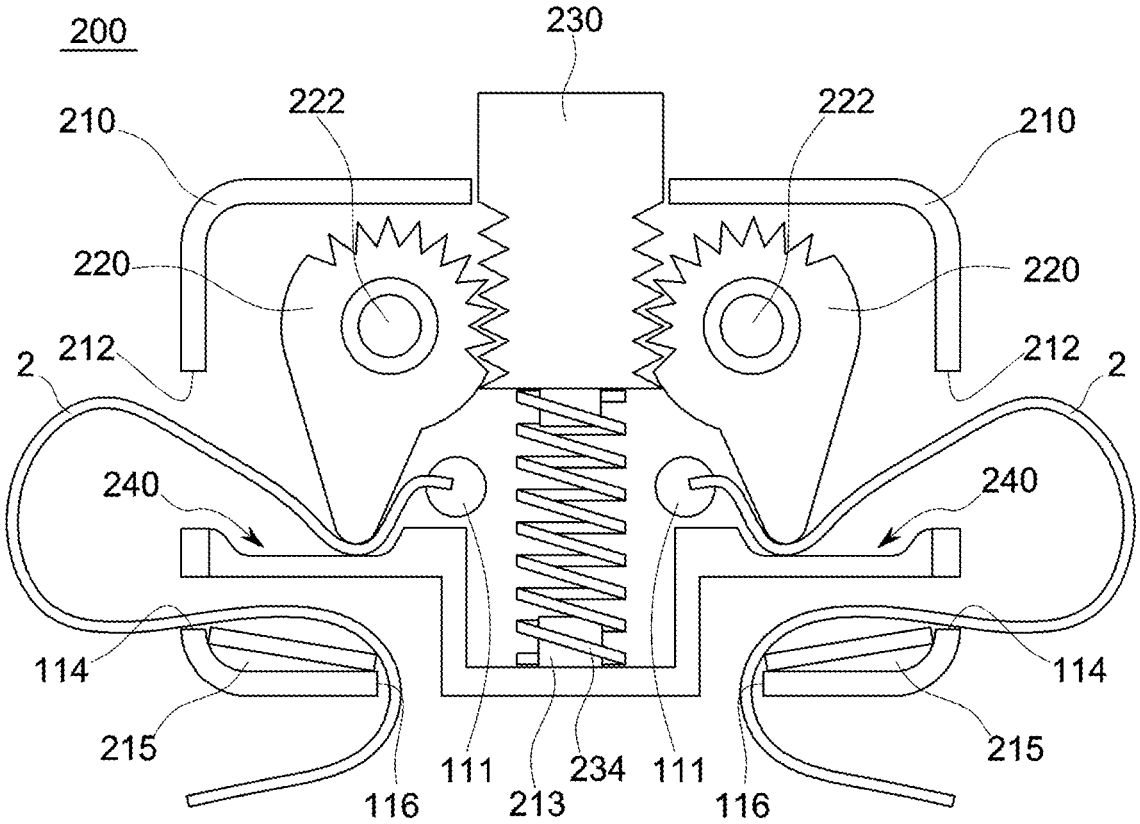
FIG. 8 is a perspective view of a lace adjustment device according to a second exemplary embodiment of the present invention.
Figure 9:
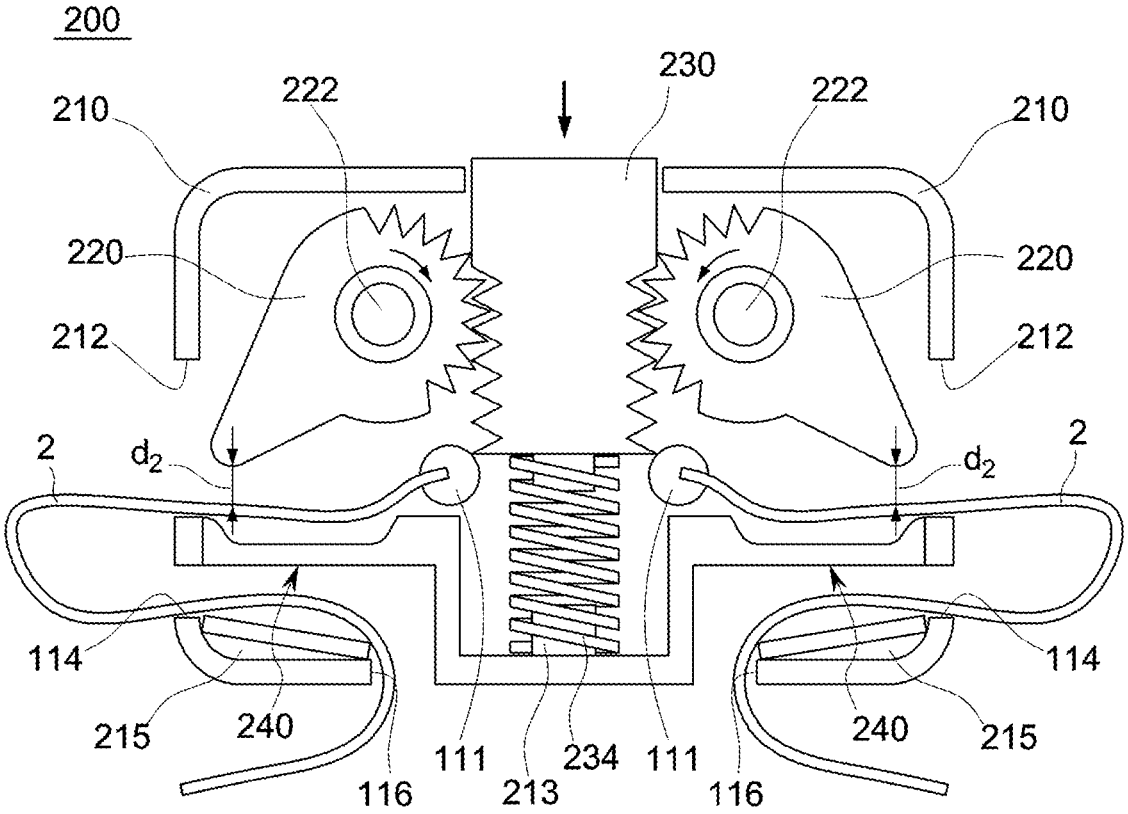
FIG. 9 is a view for explaining an operation of the lace adjustment device illustrated in FIG. 8.

Referring to FIGS. 8 and 9, the lace adjustment device 200 according to the second exemplary embodiment of the present invention includes a housing 210 which has lace insertion holes 111 into which the lace 2 provided at the shoe or the clothes is inserted, fixing levers 220 which are disposed in the housing 210 and fix the lace 2 inserted into the housing 210, and an elastic member 234 which is disposed in the housing 210 and provides elastic force to the fixing levers 220 so that the fixing levers 220 press the lace 2 inserted into the housing 210.

Because the lace adjustment device 200 according to the second exemplary embodiment of the present invention is substantially identical to the lace adjustment device according to the first exemplary embodiment except for the housing 210, the fixing levers 220, the elastic member 234, and a push member 230, the same configuration is denoted by the same name and the same reference numeral, and the description of the first exemplary embodiment will be applied to the description of the second exemplary embodiment.

The push member 230 is disposed in a central region at an upper side of the housing 210, and the pair of fixing levers 220 is provided at the left and right sides based on the push member 230.

In this case, the elastic member 234 is disposed at a lower end of the push member 230 and applies elastic force in an up-down direction, that is, in a longitudinal direction of the push member 230 or in a direction in which a push operation of the push member 230 is performed. In other words, the elastic member 234 is disposed between the push member 230 and an inner wall of the housing 210 and configured to transmit the elastic force to the fixing levers 220 through the push member 230. Here, the elastic member 234 may be a kind of mechanical element that transmits power for rotating the fixing levers 220 to the fixing levers 220. For reference, the power transmitted to the fixing levers 220 means the elastic force of the elastic member 234.

In addition, when the elastic member 234 is disposed at the lower end of the push member 230, the elastic member 234 is fitted with a protrusion member (not illustrated) provided at the lower end of the push member 230 and a coupling member 213 provided in a central region of a bottom surface of the housing 210, such that the elastic member 234 is stably interposed between the push member 230 and the housing 210.

As described above, the elastic force of the elastic member 234 is transmitted to the fixing levers 220 through the push member 230. In this case, unlike the first exemplary embodiment, the elastic member 234 according to the second exemplary embodiment of the present invention does not provide the elastic force directly to the fixing levers 120, but the elastic member 234 provides the elastic force to the fixing levers 220 through the push member 230.

Here, according to the second exemplary embodiment of the present invention, because only one elastic member 234 is installed between the push member 230 and the inner wall of the housing 210, the housing 210 is formed to have a relatively smaller size than the housing 110 according to the first exemplary embodiment. Therefore, the lace adjustment device 200 according to the second exemplary embodiment of the present invention may be implemented to be compact in size in comparison with the lace adjustment device 100 according to the first exemplary embodiment.

Meanwhile, the push member 230 is coupled to and engages with the fixing levers 220. In this case, various protruding members such as gear teeth, projections, keys-key grooves, or the like are provided on an outer surface of the push member 230 and outer surfaces of the fixing levers 220, such that the push member 230 and the fixing levers 220 engage with one another.

Here, as illustrated in FIGS. 8 and 9, according to the second exemplary embodiment of the present invention, gear teeth are formed on the outer surface of the push member 230 and the outer surfaces of the fixing levers 220, such that the push member 230 and the fixing levers 230 may stably engage and mesh with one another. For reference, the teeth are not formed on a portion of the push member 230 which protrudes from the housing 210, but the teeth are formed only on a part of the lower end of the push member 230. In addition, the teeth are not formed on the entire outer surface of the fixing lever 220, that is, the entire outer circumferential surface of the fixing lever 220, but the teeth are formed only on a portion of the fixing lever 220 which engages with the push member 230.

Meanwhile, lace outlet holes 212, which are formed in the housing 210 according to the second exemplary embodiment of the present invention, each may have a larger diameter than each of the lace outlet holes 112 formed in the housing 110 according to the first exemplary embodiment. The reason is that unlike the fixing levers 120 according to the first exemplary embodiment, the fixing levers 220 are disposed to have a long length in the up-down direction and engage with the push member 230. For this reason, if the lace outlet holes 212 are not large in the up-down direction, it may be difficult to completely release the pressure of the fixing levers 220 applied to the lace 2.

In addition, a lace support unit 240 according to the second exemplary embodiment of the present invention is formed to be stepped instead of being formed in the form of a flat plate. In this case, the lace 2 is seated at both ends of the lace support unit 240, the fixing levers 220 are positioned to press the seated lace 2, and the elastic member 234 is positioned in the central region of the lace support unit 240. Here, as described above, the coupling member 213 is formed in the central region of the lace support unit 240. For reference, the stepped portion of the central region of the lace support unit 240 may vary in accordance with a size of the elastic member 234 positioned in the central region.

Meanwhile, although not illustrated in the drawings, the components, such as the fixing levers 220, the elastic member 234, and the push member 230, for operating the lace adjustment device 220 are positioned in the housing 210, and then a housing cover (not illustrated) is coupled to a front surface of the housing 210 through coupling grooves 215. For reference, the housing cover may be coupled to the housing 210 after the lace 2 is inserted into the housing 210, or the housing cover may be coupled to the housing 210 before the lace 2 is inserted into the housing 210.

An operation of the lace adjustment device 200 according to the second exemplary embodiment of the present invention will be briefly described with reference to FIGS. 8 and 9.

First, the lace 2 of the shoe, the clothes, or the like is inserted into the housing 110 through the lace insertion holes 111 formed in the housing 210, and then the lace 2 is withdrawn through the lace outlet holes 212. Here, the lace 2 inserted into the housing 210 is pressed and fixed by the fixing levers 220.

When a part of the lace 2 is withdrawn to the outside of the housing 210, the push member 230 is pushed to adjust the length of the lace 2. In this case, when the push member 230 is pushed, the fixing levers 220, which are coupled to and engage with the push member 230, are pushed and rotated in one direction. In this case, the fixing levers 220 are rotated in the direction identical to the direction in which the push member 230 is pushed.

When the fixing levers 220 are rotated in one direction, the pressure of the fixing levers 220 applied to the lace 2 is released. In this case, when the pressure of the fixing levers 220 applied to the lace 2 is released, intervals d2 are formed between the lace 2 and the fixing levers 220.

The user adjusts the length of the lace 2 in accordance with the user's preference by loosening or pulling the lace 2 by using the intervals d2 formed between the lace 2 and the fixing levers 220. For reference, when the lace 2 withdrawn to the outside of the housing 210 is too long in length or when the user intends to prettily tie the lace 2 with respect to the shoe or the clothes, the user inserts the lace 2, which is withdrawn through the lace outlet holes 212, into the second lace insertion holes 114, and then withdraws the lace 2, which is inserted into the second lace insertion holes 114, through the second lace outlet holes 116, such that the lace 2 has a ribbon shape.

According to the lace adjustment device according to the exemplary embodiments of the present invention, the user may conveniently adjust the length of the lace provided at the shoe or the clothes by simply pressing the button instead of directly pulling and tying, from both sides, the lace attached to the shoe, the clothes, or the like.

In addition, the lace adjustment device according to the exemplary embodiments of the present invention may stably hold the lace attached to the shoe or the clothes to prevent the lace from being untied from the shoe or the clothes.

While the exemplary embodiments of the present invention have been described above with reference to particular contents such as specific constituent elements, the limited exemplary embodiments, and the drawings, but the exemplary embodiments are provided merely for the purpose of helping understand the present invention overall, and the present invention is not limited to the exemplary embodiment, and may be variously modified and altered from the disclosure by those skilled in the art to which the present invention pertains. Accordingly, the spirit of the present invention should not be limited to the described exemplary embodiment, and all of the equivalents or equivalent modifications of the claims as well as the appended claims belong to the scope of the spirit of the present invention.

INDUSTRIAL APPLICABILITY

The present invention may be used for a lace adjustment device for adjusting a lace provided at a shoe or clothes.

The invention claimed is:

1. A lace adjustment device being configured to adjust a lace provided at a shoe or clothes, the lace adjustment device comprising:

a housing which has lace insertion holes into which the lace can be inserted;

fixing levers which are disposed in the housing and configured to fix the lace inserted into the housing; and an elastic member which is disposed in the housing and provides elastic force to the fixing levers so that the fixing levers press the lace inserted into the housing, wherein the fixing levers are provided to be rotatable about pivot shafts provided in the housing, wherein the lace adjustment device further comprises a push member which is provided at a position adjacent to the fixing levers and rotates the fixing levers by a user's push operation to release a pressure of the fixing levers applied to the lace, and wherein the elastic member is disposed at a position adjacent to the push member, and the push member is configured to transmit the elastic force of the elastic member to the fixing levers.

2. The lace adjustment device of claim 1, wherein the fixing levers are provided in a pair at left and right sides based on the push member, the lace insertion holes are formed in a pair, at the left and right sides, in the housing, and the housing has a pair of lace outlet holes through which the lace, which can be inserted into the housing through the lace insertion holes, can be withdrawn to an outside of the housing, a pair of second lace insertion holes through which the lace, which can be withdrawn to the outside of the housing through the lace outlet holes, can be inserted into the housing, and a pair of second lace outlet holes through which the lace, which can be inserted into the housing through the second lace insertion holes, can be withdrawn to the outside of the housing.

3. The lace adjustment device of claim 1, further comprising:

a lace support which is provided in the housing, allows the lace inserted into the housing to be seated thereon, and supports the lace pressed by the fixing levers.

4. The lace adjustment device of claim 1, wherein the push member is coupled to and engages with the fixing levers, and the elastic member is interposed between an inner wall of the housing and the push member and provides the elastic force to the fixing levers through the push member.

5. The lace adjustment device of claim 4, wherein teeth, which engage with one another, are formed on an outer surface of the push member and outer surfaces of the fixing levers.

6. The lace adjustment device of claim 4, wherein the push member is disposed in a central region at an upper side of the housing, the fixing levers are provided in a pair at left and right sides based on the push member, and the elastic member is disposed at a lower end of the push member and applies the elastic force in a direction in which the push member is pushed.

* * * * *